United States Patent [19]

Juszak et al.

[11] Patent Number: 4,995,642

[45] Date of Patent: Feb. 26, 1991

[54] POCKET LABEL FOR SHIPPING PACKAGE AND METHOD OF MAKING

[75] Inventors: Joseph J. Juszak, Crystal Lake; John R. Poplawski, Darien, both of Ill.

[73] Assignee: Wallace Computer Services, Inc., Hillside, Ill.

[21] Appl. No.: 349,048

[22] Filed: May 8, 1989

[51] Int. Cl.[5] ..... B42D 15/00

[52] U.S. Cl. ..... 283/105; 283/81; 283/79; 283/106; 283/105

[58] Field of Search ..... 283/67, 101, 105, 106, 283/107, 108, 109, 83, 81, 82, 79; 40/638

[56] References Cited

U.S. PATENT DOCUMENTS

| | | | |
|---|---|---|---|
| 3,315,387 | 4/1967 | Heuser | 40/638 |
| 3,455,576 | 7/1969 | Hammerling | 283/81 |
| 3,508,754 | 4/1970 | Shorin | 283/105 |
| 3,524,782 | 8/1970 | Buske | 283/105 |
| 3,638,340 | 2/1972 | Gottschalk | 283/81 |
| 3,860,796 | 1/1975 | Wallace | 283/82 |
| 3,914,483 | 10/1975 | Stipek, Jr. | 283/81 |
| 3,987,960 | 10/1976 | Gardiner | 282/25 |
| 4,204,706 | 5/1980 | Blum et al. | 283/105 |
| 4,231,593 | 11/1980 | Bell, Jr. et al. | 283/82 |
| 4,306,367 | 12/1981 | Otto | 283/81 |
| 4,379,573 | 4/1983 | Lomeli et al. | 283/81 |
| 4,479,838 | 10/1984 | Dunsirn | 283/81 |
| 4,572,855 | 2/1986 | Kalus et al. | 40/638 |
| 4,821,439 | 4/1989 | Wilck | 40/638 |
| 4,846,504 | 7/1989 | MacGregor | 283/101 |

*Primary Examiner*—Paul A. Bell

*Attorney, Agent, or Firm*—Tilton, Fallon Lungmus & Chestnut

[57] ABSTRACT

A pocket label assembly for a shipping package and method of making the same, the label having a removable part for affixing to a delivery record or the like, the part being die cut from the label back and equipped with pressure sensitive adhesive and being secured to a portion removable from the envelope front to constitute a unit carrying identifying indicia.

12 Claims, 5 Drawing Sheets

POCKET LABEL FOR SHIPPING PACKAGE AND METHOD OF MAKING

BACKGROUND AND SUMMARY OF INVENTION

This invention relates to a pocket label for a shipping package and method of making the same, and more particularly, a label which has at least one removable part for pasting to a delivery record to confirm delivery of the package.

Pocket labels are well-known and have been provided in the form of an envelope having a front ply secured along three sides to a rear ply, the rear ply having pressure sensitive adhesive on its exterior face. This exterior or rear face was covered temporarily by a release liner. When the release liner was removed, this rear ply could be pasted to a shipping package and document inserted into the envelope pocket. Exemplary of such a construction is U.S. Pat. No. 3,987,960.

According to the invention, a uniquely contoured and constructed removable unit is provided which carries identifying indicia and which has a portion or portions readily separable from the front ply, taking along with it a die cut part from the rear ply equipped with pressure sensitive adhesive to enable the die cut part or parts to be adhered to a delivery document. Die-cut labels are seen in U.S. Pat. Nos. 3,914,483 and 4,379,573.

Other objects and advantages of the invention may be seen in the details of the ensuing specification.

The invention is described in conjunction with an illustrative embodiment in the accompanying drawing in which FIG. 1 is a fragmentary perspective view of the step of separating one form length from a continuous string;

Figure 12:
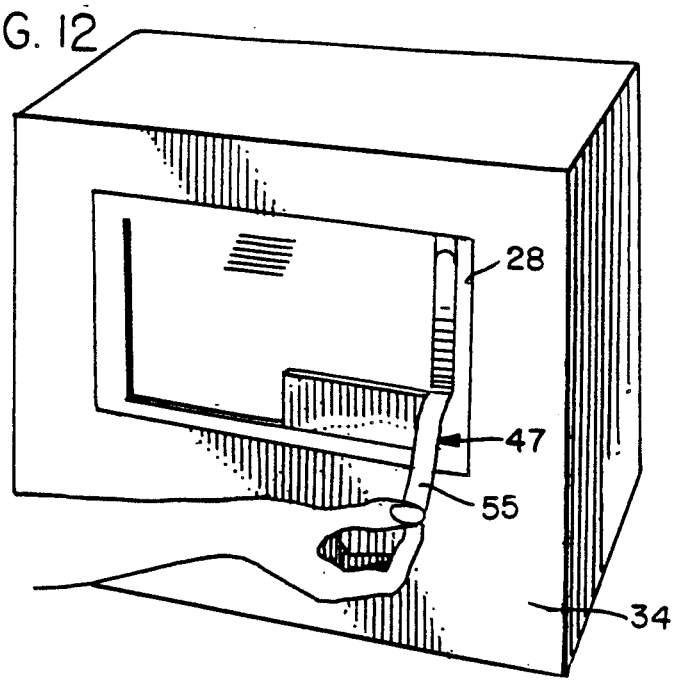
FIG. 12 is a fragmentary perspective view of the step of detaching a second delivery indicia assembly from the pasted-on pocket label of FIG. 4.
Figure 13:
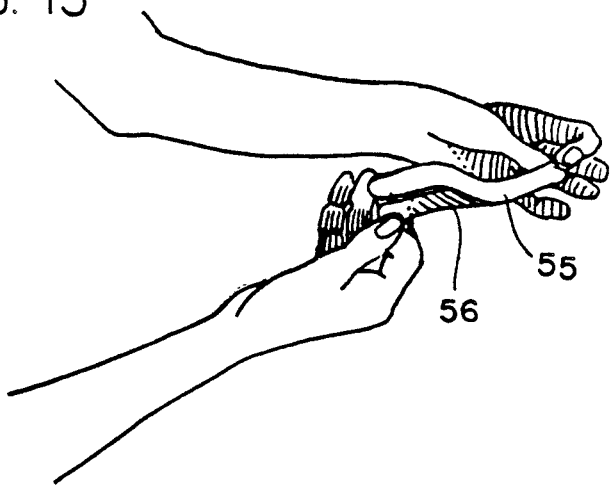
FIG. 13 is a view like, and subsequent to, FIG. 12 showing the step of detaching the delivery indicia element from the second delivery indicia assembly of FIG. 12.
Figure 15:
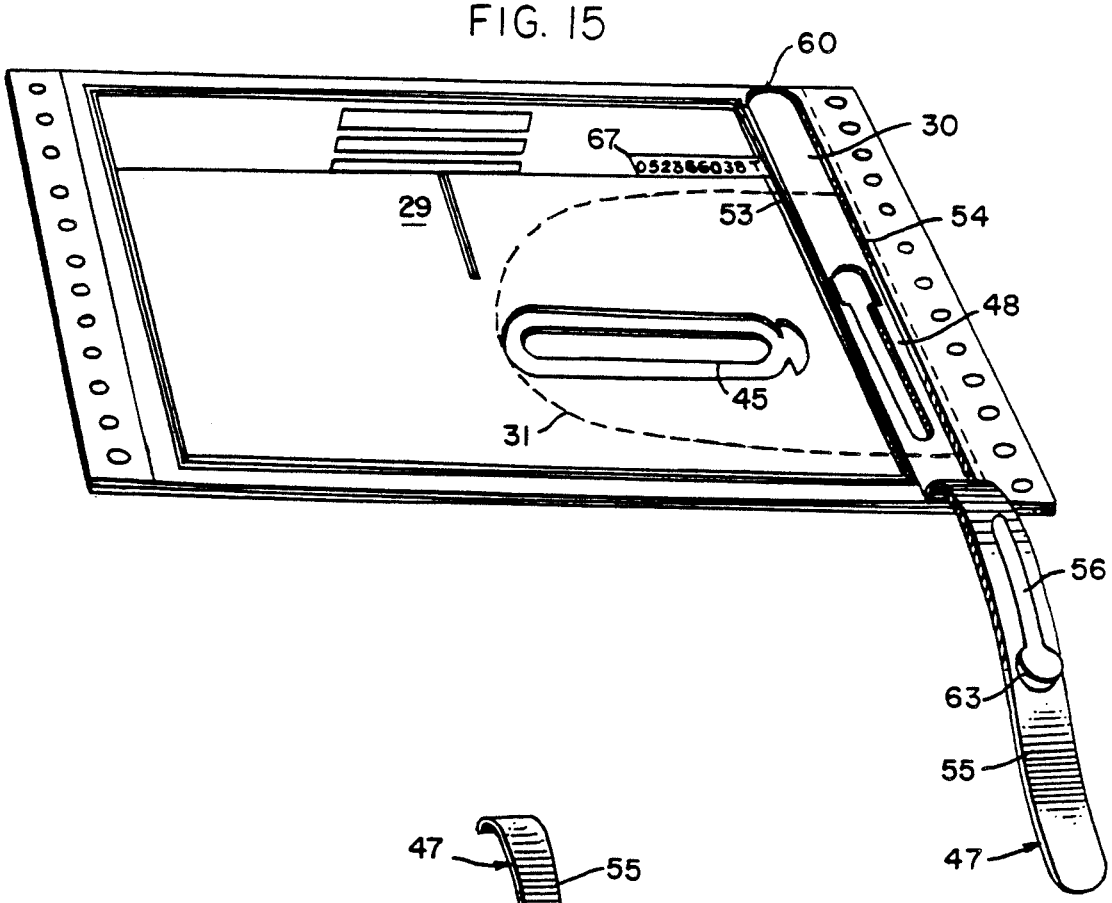
Figure 16:
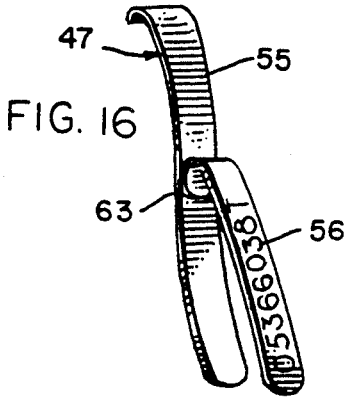

FIG. 15 is an enlarged perspective view of the pocket label showing the step of detaching the second delivery indicia assembly therefrom and corresponding essentially to the showing of FIG. 12; and FIG. 16 is an enlarged perspective view showing the delivery indicia element in the process of detachment from the second delivery indicia assembly and corresponding essentially to the showing of FIG. 13.

DETAILED DESCRIPTION

It should be appreciated that two delivery indicia assemblies are provided because one may be used on one delivery record while the other on a second delivery record. In one specific application of the invention, the first indicia is applied to the "out for delivery manifest" which occurs at the time the courier leaves the distribution point and is on his/her way to the recipient. Then, at the recipient's address, the second indicia is detached for affixing to the "delivery manifest". This is then signed by the recipient to indicate proof of delivery. Thus, two documents are generated at different stages of delivery which can be cross-matched to advise the shipping customer of status of delivery.

Because it is believed that the invention will be better understood by going through the method of using the inventive pocket label, reference is first made to the sequence of steps depicted in FIGS. 1–6.

Figure 1:
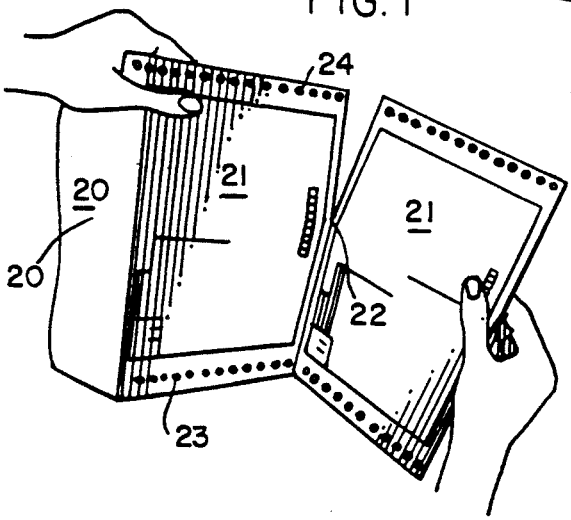

In FIG. 1 the numeral 20 designates generally a continuous string of form lengths each designated 21. The right hand-most form length is in the process of being separated from the string 20 along a line of transverse perforation 22. By the time of separation, thc various form lengths have been printed with "variable" information, i.e., a shipper's name, address, the recipient's name and address, etc. This is normally done by computer with the string 20 being advanced through line holes provided in the control margins 23, 24. The line holes in the control margins are also employed during the manufacture of the string of form lengths as will be brought out hereinafter.

Figure 2:
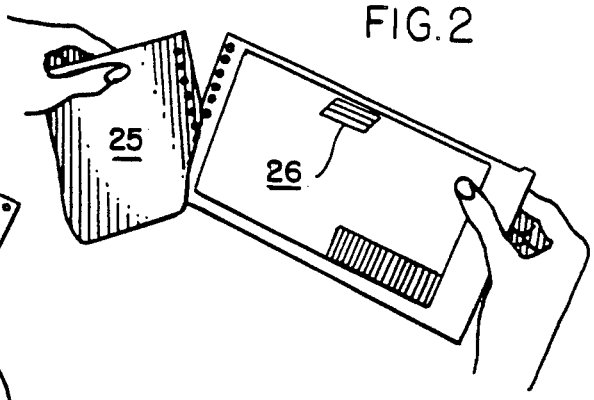
FIG. 2 is a view like FIG. 1 but showing the subsequent step of removing the office plies from the one form length of FIG. 1 to provide a pocket label assembly.

Referring now to FIG. 2, the step of separating the office copies is illustrated. The office copies 25 may include the shipper's copy, a scan copy and an origin copy. Carbon plies may be interspersed or the various copy plies can be constructed of carbonless paper. Remaining after the separation of the office copies 25 is the pocket label assembly 26—see the right hand portion of FIG. 2.

Figure 3:
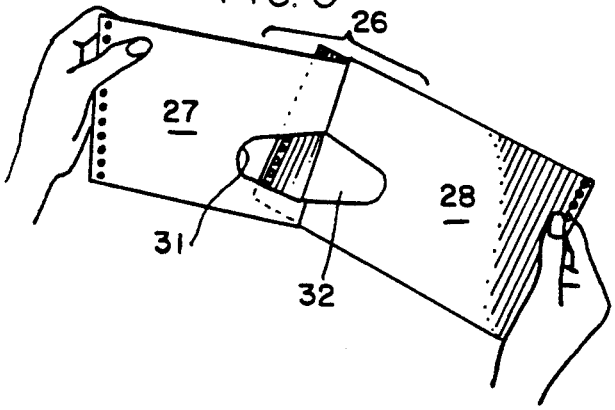
FIG. 3 is a view like FIGS. 1 and 2 but showing the still subsequent step of peeling the release liner from the pocket label assembly of FIG. 2 to provide a pocket label.

Referring now to FIG. 3, the next step performed by the shipper or courier is illustrated. This consists of peeling off the release liner 27 from the pocket label assembly 26. This results in the pocket label 28 which consists of two plies, a top ply 29 and a bottom ply 30—see the designation at the extreme left hand side of FIG. 8. Also shown there is the release liner 27.

Referring again to FIG. 3, an advantageous feature of the invention resides in the die cut 31 in the release liner 27. As illustrated, this is generally semi-elliptical and can be seen in dashed line in FIG. 7. This results in a die cut segment 32 of the release liner—still referring to FIG. 3 — which remains with the pocket label 28 after removal of the rest of release liner 27. More particularly, the segment 32 remains adhesively attached to the rear face of the bottom ply 30 which has been previously equipped with a pressure sensitive adhesive 33—see the "X's" in FIG. 8 interposed between the bottom ply 30 and the release liner 27. The retention of the segment 32 enables certain die cut parts of the bottom ply 30 to be free of attachment to the shipping carton and thus provide means for removing the delivery indicia information at subsequent times.

Figure 4:
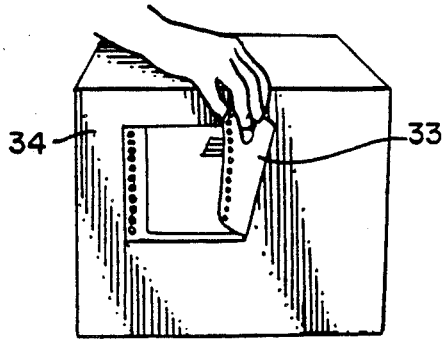
FIG. 4 is a view like, but subsequent to, that of FIG. 3 and showing the pasting of the pocket label of FIG. 3 on a shipping carton or package for shipment.

Referring now to FIG. 4, the pocket label 28 is seen in the process of being applied to a shipping carton 34. This is facilitated by the provision of the pressure sensitive adhesive 33 on the rear or bottom face of the bottom ply 30.

Figure 5:
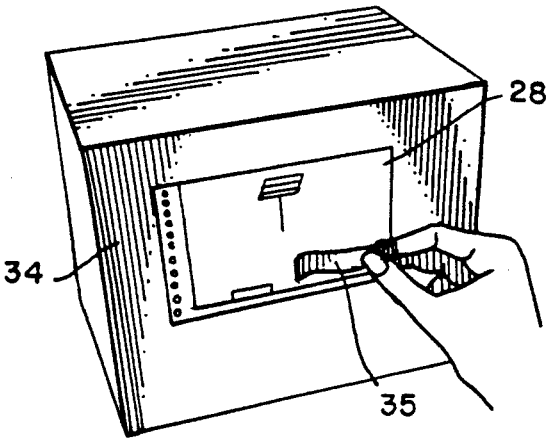
FIG. 5 is a fragmentary perspective view of the carton in the hands of the delivering courier and showing the step of detaching a first delivery indicia assembly from the pasted-on pocket label of FIG. 4.

Referring now to FIG. 5, the carton 34 is now in the delivery terminal and the carrier's representative is seen in the process of removing a first delivery indicia assembly 35 from the pasted on pocket label 28. This step can be seen in larger scale and in more detail in the central portion of FIG. 9. In the illustration given, the first delivery indicia assembly 35 is equipped with bar code information as can be best seen in the lower right hand portion of FIG. 7. It will be appreciated that additional assemblies similar to 35 can be provided bearing other bar code information.

Figure 6:
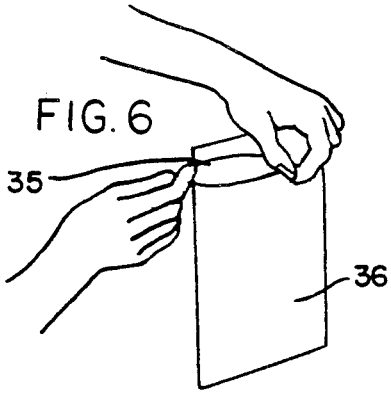
FIG. 6 is a view like FIG. 5 but of the subsequent step of applying the first delivery indicia assembly of FIG. 5 to a delivery document.

The operation is completed as illustrated in FIG. 6 where the carrier's representative is seen applying the first delivery indicia assembly 35 to a an "out for delivery manifest" 36. This then provides concrete evidence that the package has been dispatched for delivery from the terminal.

Figure 7:
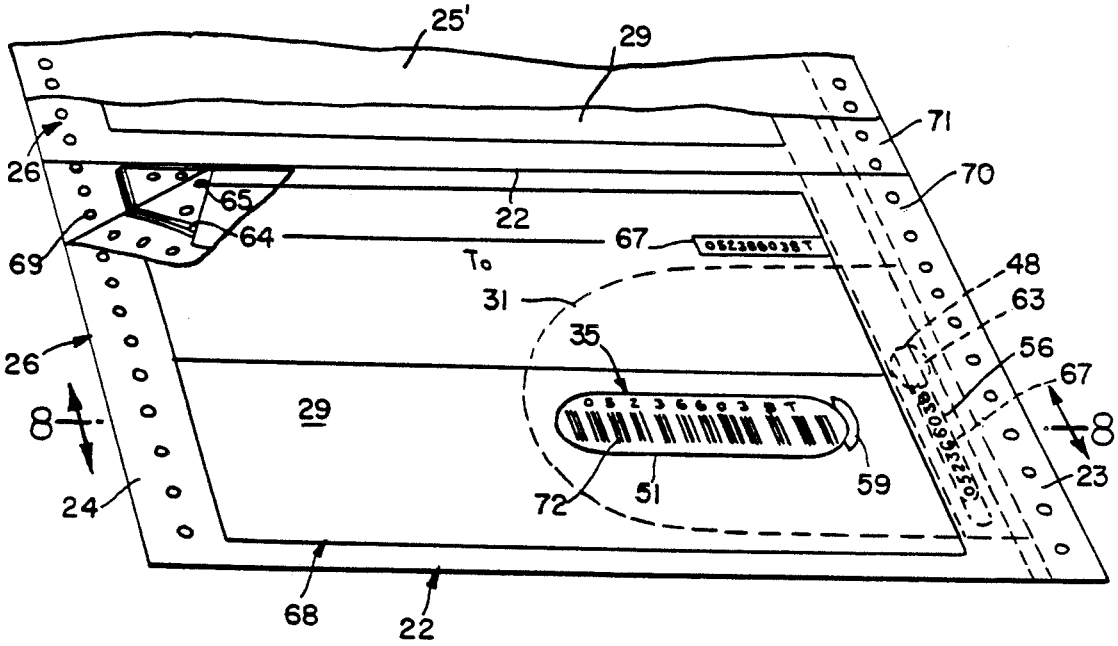
FIG. 7 is an enlarged fragmentary perspective view of the string of form lengths.
Figure 8:
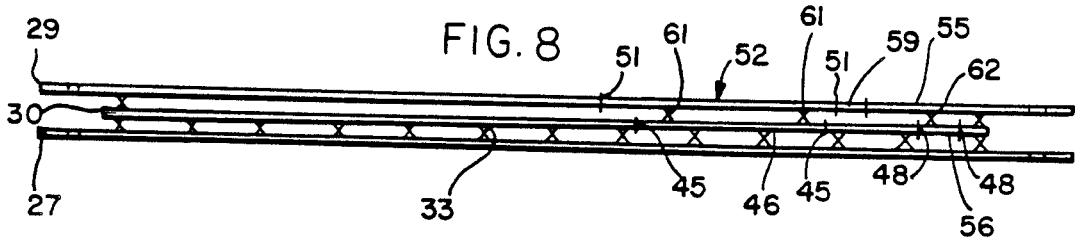
FIG. 8 is a sectional view taken along the sight line 8—8 of FIG. 7 and which is essentially schematic in showing the various parts slightly separated for ease of understanding.
Figure 9:
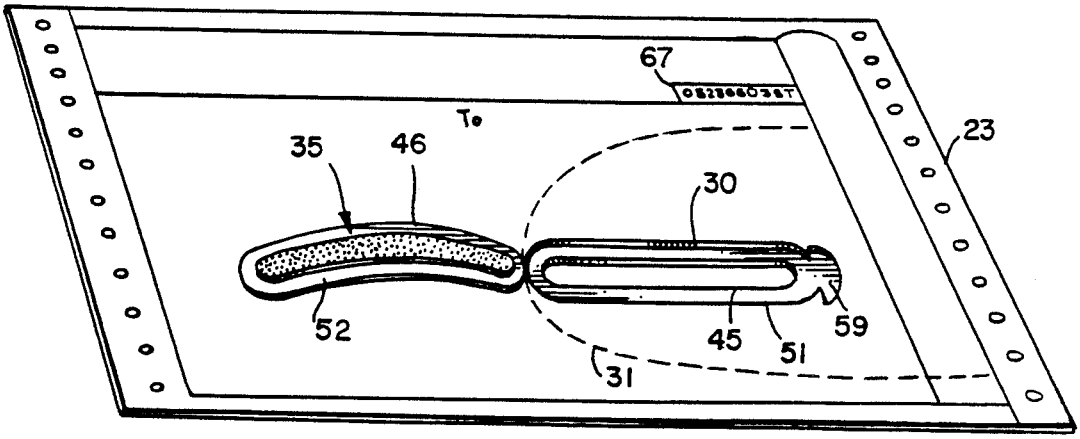
FIG. 9 is an enlarged perspective view of the pocket label seen in FIG. 5.

Inasmuch as die cutting is an important feature of the invention, the method of producing the continuous string 20 of form lengths 21 will now be described in conjunction with FIGS. 10 and 11. The skipped views, FIGS. 7-9, show structural details which will be referred to in connection with the description of the method of manufacture.

METHOD OF MANUFACTURE

Figure 10:
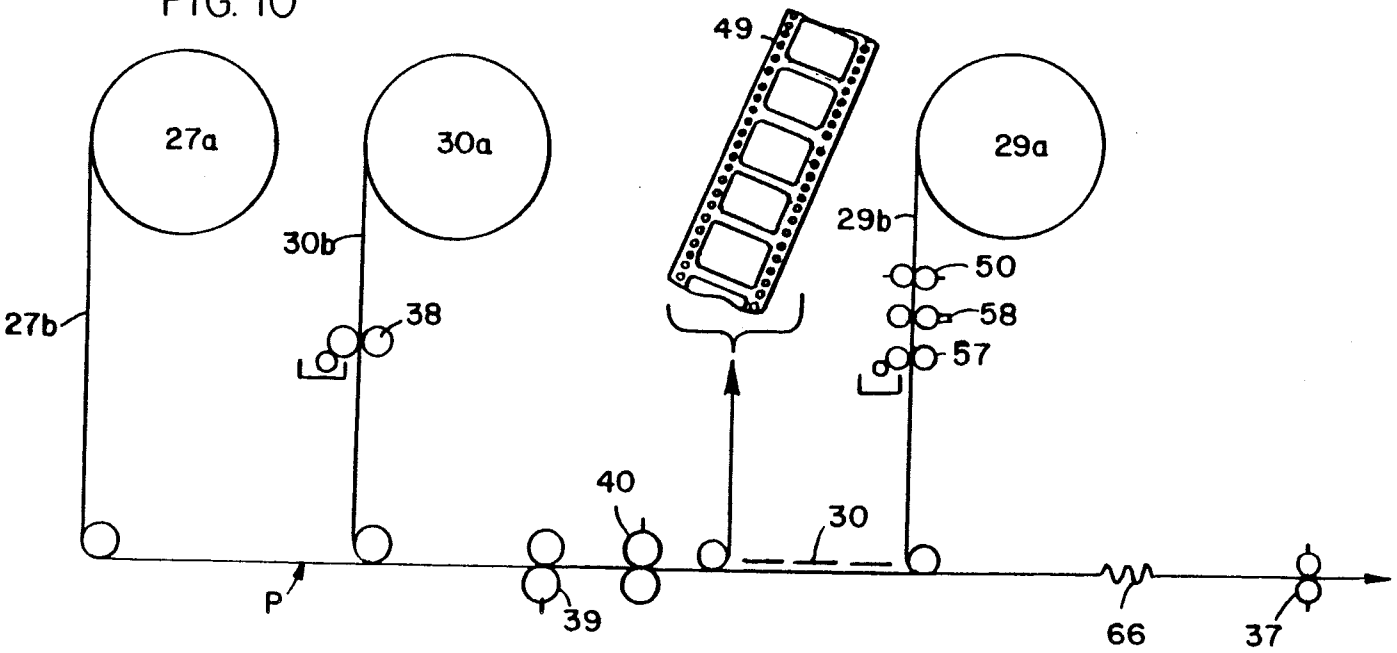
FIG. 10 is a schematic representation of a collator which could be employed to make the inventive pocket label assemblies.

In actual practice, the various steps depicted in FIG. 10 are performed at different locations. For example, the forms manufacturer can purchase from another source the bottom ply complete with pressure sensitive adhesive and release liner as a laminate. This, then, is printed and die cut on press equipment at the plant of the forms manufacturer. The other plies are likewise subjected to press operation for printing, punching and perforation as needed. Thereafter, the various plies—in the form of parent rolls—are brought to the collator and assembled in superposed relation through the use of line holes.

However, to illustrate more in detail what actually occurs at the various locations where these steps are performed, the schematic presentation of FIG. 10 will now be referred to. This, in effect, illustrates what could be done in the manufacture of the pocket label if it occurred from raw materials brought all to a single site.

To provide the release liner 27, a parent roll 27*a* is provided which usually is constructed of silicone-coated material. In the illustration given, the web 27*b* unwound from the parent roll 27*a* is advanced along a predetermined path P in the suitable machine such as a collator. There it is assembled with the other webs in superposed relation and can be transversely perforated with the other assembled webs by a perforator 37—see the extreme right hand portion of FIG. 10.

Next, a parent roll 30*a* can be provided which provides a continuous web 30*b* ultimately resulting in the bottom ply 30 of the pocket label 28. The web 30*b* is passed through a coating unit 38 which applies the coating 33 of pressure sensitive to the bottom surface of the web 30*b*. Thereafter, the web 30*b* is introduced into the predetermined path P for adhesive union with the release liner web 27*b*. This is the laminate usually purchased.

Downstream of the point of union, we provide a die cutting mechanism which, for ease of understanding, is illustrated in two sections as at 39 and 40. The die cutting section 39 is responsible for making the die cut 31 in the release liner 27 which results in the segment 32 retained in covering relation to the pressure sensitive adhesive 33 on the bottom surface of the bottom ply 30.

Figure 11:
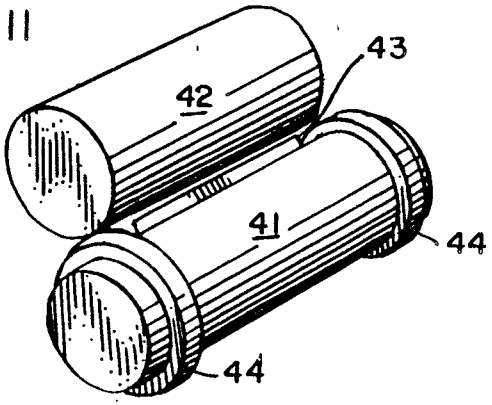
FIG. 11 is a fragmentary perspective view of a die-cutting mechanism useful in the collator of FIG. 10.

Schematically illustrated in FIG. 11 is a die cutting mechanism which includes a pair of rolls 41, 42. The roll 41 is the knife roll and is equipped with a radially projecting knife 43 which coacts with the anvil roll 42 in making the die cut— 31, for example. The knife roll 41 is equipped with bearer rings 44 adjacent the ends thereof which insure a spacing between rolls 41, 42 sufficient to permit passage of the laminated web consisting of the release liner 27 and bottom ply 30*b* therebetween. The knife 43 projects only partway of this spacing that is maintained by the bearer rings 44 so that the die cut occurs only in one web of the laminate—the release liner in the illustration given.

This technique of cutting only one or some of superposed plies, is well known and many forms of die cutting mechanisms are available. In any event, the operation provided by the die cutting section 39 results in cutting only the pattern of segment 32 in the release liner web 27*b*—leaving the ply 30*b* unaffected.

The second die cutting mechanism section 40 performs the same type of operation but this time only relative to the continuous web 30*b* of the pocket label assembly 26.

The section 40 develops three specific die cut patterns. First, it cuts an obround pattern 45 in the bottom ply 30—see the central right hand portion of FIG. 9. This ultimately constitutes a part 46 of the first delivery indicia assembly 35—see the left central portion of FIG. 9.

A second pattern provides a part of the second delivery indicia assembly generally designated 47 in the lower right hand portion of FIG. 15. More particularly, the die cut in the ply 30 is designated 48 and is seen to be generally spade-shaped. It will be appreciated that both the die cuts at 45 and 48 are within the perimeter of the die cut 31—still referring to FIG. 15—so that the pressure sensitive adhesive is covered by the segment 32. This then enables the first and second delivery indicia assemblies to be detached from the pocket label while still retaining a pressure sensitive surface for adherence to the delivery records.

The third pattern of die cutting which can be performed at the section or station 40 is essentially a "trimming" operation whereby windows are cut into the web 30*b* to provide a ladder-like trim 49. This is peeled away for discard—see the upper central portion of FIG. 10. Thus, at this point in the manufacture, the bottom ply 30 is completely overlapped along all four edges by the release liner ply 27*b*.

Next, still another parent roll 29a is provided which, when unwound, results in the top ply 29b of the pocket label assembly 26. The webs 29b and 30b have been printed prior to being wound into rolls 29a and 30a. Before being joined to the plies 30, 27, the web 29b is subjected to three operations. First, it is perforated as at 50 to provide a generally obround (straight sides with rounded ends) pattern 51—see the lower right hand portion of FIG. 9. This provides a portion 52—see the left hand portion of FIG. 9—which circumscribes the die cut part 46 from the bottom ply 30.

In like fashion, the top ply 29 is longitudinally perforated (in the direction of web advance) along the lines 53, 54 (see the right hand portion of FIG. 15) so as to provide the second delivery indicia assembly or unit 47. In other words, the removal of the portion 55 (referring to FIG. 15) from the top ply 29 takes with it the die cut part 56—just as the removal of the portion 52 takes with it the part 46 in the first delivery indicia assembly where this is illustrated in FIG. 9. The elements 52, 46 and 55, 56 are adhesively secured together by adhesive applied at the station 57 along with other patterns of adhesive which will be described hereinafter.

To facilitate the removal for detachment of the first and second delivery indicia assemblies we provide a chip-providing station 58—see the right hand portion of FIG. 10. Relative to the first delivery indicia assembly 35, a chip is punch removed at 59—see the lower right hand portion of FIG. 7. This opening in the top ply 29 permits finger insertion under the top ply for removal of the first indicia assembly 35 as illustrated in FIG. 5.

A chip can also be removed (as by punching) to facilitate the start of detachment of the second indicia assembly 47 but we have found it simpler to provide an arcuate cut 60 at the downstream end of the top ply 21—see the upper right hand portion of FIG. 15. This again permits easy fingernail insertion under a portion of the top ply 29 for stripping removal of the second indicia assembly 47.

Referring again to FIG. 10, the adhesive coating mechanism 57, in addition to providing adhesive for securing the elements of the two indicia assemblies together, also provides the adhesive for uniting perimetrically the top and bottom plies 29, 30. First, relative to the union of the part 46 and portion 52 making up the first indicia assembly 35 (best seen in the left central portion of FIG. 9), we provide patches of adhesive 61—see the right central portion of FIG. 8. These are seen to be adjacent the ends of the part 46—as limited by the die cut line 45 and somewhat inward of the ends of the portion 52— as limited by the perforation line 51. Second, in similar fashion, we provide a patch of adhesive 62 (see the right hand portion of FIG. 8) on the underside of ply 29 in the area of the tab portion 63 of the part 56 developed by the die cut 48 (see the central right hand portion of FIG. 7). This can be seen clearly in FIG. 16 where only one end of the part 56 is attached to the portion 55.

The adhesive applying section 57 also applies longitudinally extending lines of adhesive along the sides of the top ply 29 of the pocket label assembly 26 as indicated at 64—see the upper left hand portion of FIG. 7. The section 57 also applies spaced dots of adhesive 65 transversely of the ply 29 and these longitudinal and transverse patterns of adhesive are provide along the other sides so as to have the perimeter of the bottom ply 30 adhesively united to the top ply 29 of the pocket label assembly 26.

Returning again to FIG. 10, the interruption of the path P at 66 indicates that there are other webs making up the office copies are superposed on the three ply assembly providing the pocket labels and thereafter the cross perforation provided station 37.

Completing the description of the drawing views, FIG. 12 shows the second indicia unit or assembly 47 in the process of being detached from the pocket label 28 applied to the shipping package or carton 34—much like the showing in FIG. 5.

Figure 14:
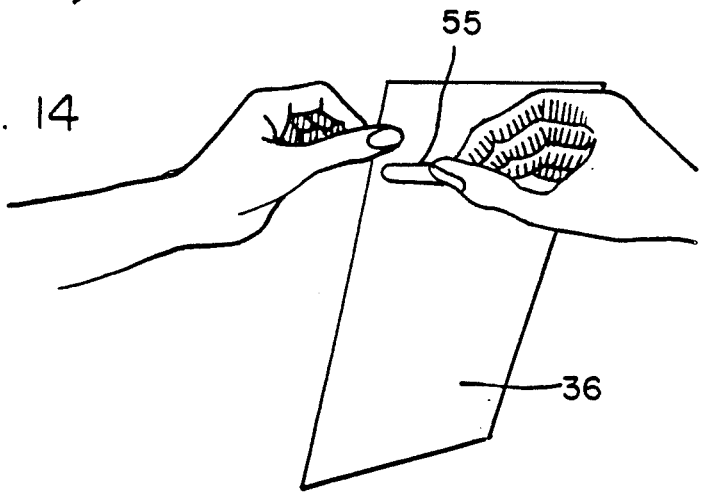
FIG. 14 is a fragmentary perspective view showing the step of attaching the delivery indicia element of FIG. 13 to a delivery record.

FIG. 13 shows the detachment of the part 56 from the portion 55 and FIG. 14 shows the application of the part 56 to the delivery manifest 36'.

STRUCTURE OF POCKET LABEL ASSEMBLY

In the illustration given and with reference first to FIG. 7, the numeral 26 designates generally the pocket label assembly of the invention. It includes a top ply 29 which contains blanks for information pertinent to the shipment such as sender and recipient. Normally, the forms manufacturer will print carrier information on ply 29 such as the carrier's shipment number 67 in one position—with all of the information confined within the box outline generally designated 68. Thus, when both assemblies 35 and 47 are removed, there still remains information indicia associated with the carton.

This printing is normally performed in the press section of the manufacturing plant. As mentioned previously, the top ply is equipped with longitudinally extending (in the direction of web travel during manufacture) control punched margins as at 23 and 24 (see also FIG. 1).

The pocket label assembly 26 also includes a bottom ply 30 equipped with pressure sensitive adhesive 33 on the surface thereof away from the top ply 29. This bottom ply 30 ultimately constitutes the label back—when the release liner 27 is peeled away from the assembly 26. The release liner is initially disposed in covering relation to the adhesive 33. After peeling, the liner segment 32 remains in covering relative to a part of the adhesive 33. The bottom ply 30 does not have control margins as also can be appreciated from a consideration of FIG. 8 and is generally perimetrically secured to the top ply 29. This can be appreciated from the upper left-hand corner of FIG. 7 where a longitudinally extending line of adhesive 64 has been applied to the underside of the top ply 29 adjacent the line holes 69. This overlies edge portion of the bottom ply 30 and provides the longitudinally extending union between the top ply 29 and the bottom ply 30. A similar line is provided adjacent the line holes 70 in margin 23. For transverse union generally along the perimeter of the bottom ply 30, spaced dots of adhesive as at 65 are applied to the underside of the top ply 30 adjacent both lines of transverse perforation 22.

It will be appreciated that it is no longer necessary to provide the "pocket" of the envelope of the '960 patent but the nomenclature "pocket label" is still retained in the art, notwithstanding the fact that there is no longer an accessible pocket per se. However, the operation in use is the same—as described first above.

OVERALL CONSTRUCTION

It will be appreciated that the pocket label assemblies 26 are made in a continuous string. In FIG. 7, the next adjacent pocket label assembly is also designated by the numeral 26 with the top ply also being designated 29. Normally, a plurality of further plies are provided above the top ply such as the shipper's copy, a scan copy and an origin copy. One of these is shown in the upper portion of FIG. 1 and is designated 21'. These additional copies are secured to the pocket label assemblies by longitudinally extending lines of adhesive as at 71 which are applied to the control margins at the time of manufacture. The adjacent pocket label assemblies are separated by longitudinally spaced apart, transversely extending lines of potential severance or perforation as at 22—see the upper central portion of FIG. 1. These normally are lines of perforation which are aligned in all of the continuous webs— the only web not being continuous in the final product being that providing the bottom ply 30. Thus, when the shipper's copy etc. are removed, there remains the pocket label assembly 26. Then, when a portion of the release liner 27 is removed—the segment 32 remaining—the pocket label 28 is ready for affixing to the shipping package.

While, in the foregoing specification, a detailed description of the invention has been set down for the purpose of illustration, many variations in the details hereingiven may be made by those skilled in the art without departing from the spirit and scope of the invention.

We claim:

1. A pocket label comprising superposed, generally rectangular top, bottom and release liner plies, said bottom ply having pressure sensitive adhesive on substantially the entire surface thereof confronting said release liner ply, said release liner ply being die cut to form a generally half-elliptical segment projecting inwardly from one side edge of said release liner ply, a closed die cut line in said bottom ply lying within the periphery of said segment and providing a part removable from said bottom ply, and a closed line of perforation in said top ply generally concentric with said bottom ply closed die cut line and providing a portion removable from said top ply, said bottom ply part and said top ply portion being adhesively united whereby said top ply portion and bottom ply part are detachable from said segment as a unit, and identification indicia on said top ply portion.

2. The label of claim 1 in which said bottom ply and said top ply portion are both generally oblong with rounded ends.

3. The label of claim 2 in which said indicia are on said top ply portion and includes a bar code.

4. A pocket label comprising superposed, generally rectangular top ply, bottom ply and a release liner ply, said bottom ply having pressure sensitive adhesive on substantially the entire surface thereof confronting said release liner ply, said release liner ply being die cut to form a generally half-elliptical segment projecting inwardly from one edge of said release liner ply, a closed die cut line in said bottom ply lying within the periphery of said segment and providing a part removable from said bottom ply, identifying indicia on said bottom ply part, and a line of perforation in said top ply adjacent said one edge and parallel thereto to provide a portion removable from said top ply, said top ply portion and bottom ply part being adhesively united adjacent one end of said bottom ply part to provide a connecting tab on bottom ply said part, and a line of weakness between said tab and the remainder of said bottom ply part.

5. A pocket label for a shipping package comprising top and bottom generally rectangular superposed plies secured along four sides, said bottom ply constituting the label back and having pressure sensitive adhesive on substantially the entire exterior surface thereof a release liner covering said adhesive whereby, when said liner is removed, said label can be affixed to said package, said release liner being equipped with a die cut providing a segment remaining with said bottom ply when said release liner is removed incident to affixing said bottom ply to said package, said top ply constituting the label front and having printed delivery indicia thereon for identifying said package, delivery indicia also being provided in a second location on one or both of said first and second plies, said top ply being equipped with a line of weakness for providing a portion removable from said top ply and having said second location indicia associate therewith, said bottom ply being equipped with a closed perimeter die cut providing a part circumscribed by the perimeter of said top ply portion and also being circumscribed by the perimeter of said segment, said bottom ply part being adhesively united to said top ply portion at least adjacent one end of said bottom ply to cause said bottom ply part to be detached from said package when said top ply portion is removed from said top ply.

6. The label of claim 5 in which said top ply is equipped with a punched opening abutting said line of weakness to provide finger access to the underside of said top ply for removal of the united top ply portion and the bottom ply part.

7. A pocket label comprising a generally rectangular information-containing top ply, a generally rectangular bottom ply having its periphery adhered to said top ply and equipped with a pressure sensitive adhesive on the bottom face thereof extending substantially over the entire bottom face for applying said bottom ply to a shipping package, a generally rectangular release liner detachably covering said adhesive, a closed perimeter die cut in said bottom ply providing a part removable therefrom, perforation means in said top ply spaced from said bottom ply die cut providing a portion removable from said top ply, and a die cut in said release liner spaced from said bottom ply die cut providing a segment remaining with said bottom ply when said release liner is detached from said bottom ply incident to applying said bottom ply to said package, said closed perimeter die cut in said bottom ply being spaced inwardly of the perimeter of said segment and also is spaced inwardly of the perimeter of said top ply portion, said bottom ply part being adhesively united to said top ply portion whereby said top ply portion and bottom ply part are detachable from said segment as a unit, said unit being equipped with package-identifying indicia.

8. The label of claim 7 in which said indicia is on said top ply portion.

9. The label of claim 7 in which said indicia is on said bottom ply part.

10. The label of claim 9 in which said bottom ply is relatively elongated and equipped at one end with a tab adhesively secured to said top ply portion, a line of perforation between said tab and the remainder of said relatively elongated bottom ply part with said remainder being free of adhesive union to said top ply portion and with said indicia being on said remainder.

11. The label of claim 7 in which said top ply is equipped with cut-out adjacent the top ply. portion-providing perforation means permitting finger insertion under said top ply portion for removal of said unit, said top ply portion being equipped with said indicia.

12. The label of claim 1 in which said indicia includes a bar code.

* * * * *